US007963809B2

(12) United States Patent
Hardell et al.

(10) Patent No.: US 7,963,809 B2
(45) Date of Patent: Jun. 21, 2011

(54) MICRODVI CONNECTOR

(75) Inventors: Dave Hardell, San Jose, CA (US); Glenn E. Wheelock, San Jose, CA (US); Chris Ligtenberg, San Carlos, CA (US); Steve Sfarzo, Los Gatos, CA (US); William Cornelius, Los Gatos, CA (US); Bartley K. Andre, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/242,784

(22) Filed: Sep. 30, 2008

(65) Prior Publication Data

US 2009/0186527 A1 Jul. 23, 2009

Related U.S. Application Data

(60) Provisional application No. 61/019,278, filed on Jan. 6, 2008.

(51) Int. Cl.
*H01R 13/64* (2006.01)

(52) U.S. Cl. ..... 439/680

(58) Field of Classification Search ..... 439/680, 439/660, 357, 358, 924.1
See application file for complete search history.

(56) References Cited

U.S. PATENT DOCUMENTS

| | | | | |
|---|---|---|---|---|
| 6,379,193 | B1 * | 4/2002 | Fujii et al. | 439/680 |
| 6,461,196 | B2 * | 10/2002 | Wilson et al. | 439/633 |
| 6,824,969 | B1 * | 11/2004 | Ko | 439/680 |
| 6,948,984 | B2 * | 9/2005 | Chen et al. | 439/660 |
| 7,318,752 | B2 * | 1/2008 | Fujimoto et al. | 439/660 |
| 7,354,282 | B2 * | 4/2008 | Margulis et al. | 439/79 |
| 7,359,208 | B2 * | 4/2008 | Ni | 361/752 |
| 7,402,084 | B2 * | 7/2008 | Wu | 439/660 |
| 7,467,977 | B1 * | 12/2008 | Yi et al. | 439/607.01 |
| 7,537,489 | B2 * | 5/2009 | Feridani et al. | 439/660 |
| 7,594,827 | B2 * | 9/2009 | Takamoto et al. | 439/660 |
| 7,625,243 | B2 * | 12/2009 | Chen et al. | 439/660 |
| 2001/0007803 | A1 * | 7/2001 | Wilson | 439/633 |
| 2002/0142666 | A1 * | 10/2002 | Nishio et al. | 439/660 |
| 2005/0048846 | A1 * | 3/2005 | Suzuki et al. | 439/660 |
| 2005/0124219 | A1 * | 6/2005 | Chen et al. | 439/607 |
| 2005/0202727 | A1 * | 9/2005 | Andre et al. | 439/660 |
| 2006/0094301 | A1 * | 5/2006 | Lee et al. | 439/660 |
| 2006/0134983 | A1 * | 6/2006 | Wang et al. | 439/607 |
| 2006/0154530 | A1 * | 7/2006 | Novotney et al. | 439/660 |
| 2007/0049119 | A1 * | 3/2007 | Fujimoto et al. | 439/610 |
| 2007/0072491 | A1 * | 3/2007 | Huang | 439/660 |
| 2007/0293088 | A1 * | 12/2007 | Hiew et al. | 439/610 |
| 2009/0117754 | A1 * | 5/2009 | Fields et al. | 439/55 |
| 2009/0157938 | A1 * | 6/2009 | Hunkins et al. | 710/306 |
| 2009/0176413 | A1 * | 7/2009 | Degner et al. | 439/652 |
| 2009/0186529 | A1 * | 7/2009 | Chiang | 439/660 |

* cited by examiner

*Primary Examiner* — T C Patel
*Assistant Examiner* — Vladimir Imas
(74) *Attorney, Agent, or Firm* — Kilpatrick Townsend & Stockton LLP

(57) ABSTRACT

A small form-factor, high performance connector is disclosed. This connector is intended for use with high bandwidth digital video, implementing differential digital signaling, as well as for high bandwidth analog video. The described connector system performs the function of the Digital Visual Interface (DVI) connector, but in a significantly smaller package. Signal integrity is maintained in the smaller form factor by the expedient assignment of signals to pins so that the pin above or below any signal is not used on that interface, thus reducing the chances for signal crosstalk. The pin shape and spacing are created to match pin lengths and minimize inductance while maintaining the proper impedance up to 2.5 GHz. This connector system also implements a tactile feedback mechanism to aid with cable plug insertion, and incorporates a keying mechanism to prevent reverse-plugging.

23 Claims, 16 Drawing Sheets

1. Pins may be on one or both sides.
2. Pins on a side may have different sizes and spaces to adjacent pins.
3. Pins on a side may have different sizes and spacing as compared to other side.

1. 5V DDC power
2. GND
3. TMDS 2P
4. TMDS 2N
5. GND
6. TMDS 1P
7. TMDS 1N
8. GND
9. TMDSCLKP
10. TMDSCLKN
11. GND
12. TMDS 0P
13. TMDS 0N
14. GND
15. DDC CLK
16. DDC DAT
17. DVI host pull-up/ down

| 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|

BOARD

Active pins in VGA mode include 1, 15, 16, 18-33 and GNDs.

Active pins in DVI mode include 1-17, 18, 34, and GNDs.

| 18 | 19 | 20 | 21 | 22 | 23 | 24 | 25 | 26 | 27 | 28 | 29 | 30 | 31 | 32 | 33 | 34 |
|---|---|---|---|---|---|---|---|---|---|---|---|---|---|---|---|---|

18. Hotplug detect
19. GND
20. No pin
21. VGA red
22. No pin
23. GND (VGA red return)
24. No pin
25. VGA green
26. No pin
27. GND (VGA green return)
28. No pin
29. VGA blue
30. No pin
31. GND (VGA blue return)
32. VGA HSYNC
33. VGA VSYNC
34. HDMI host pull-up/ down

FIGURE 7

MICRODVI CONNECTOR

CROSS-REFERENCES TO RELATED APPLICATIONS

This application claims the benefit of U.S. provisional application No. 61/019,278, filed Jan. 6, 2008, titled "MICRODVI CONNECTOR," which is incorporated by reference.

BACKGROUND

Many electronic devices connect to each other using cables typically made up of a number of wires connected to pins located in connectors at each end of the cable. These connectors then mate with connectors in the electronic devices. These connectors may be based on a standard, that is, the connector may have an agreed-to size and pin location, or they may be proprietary.

Other connectors may be a hybrid of these, that is, the pin functions may be standardized, but the pin locations and connector form factor may be proprietary. Such a connector may be used on one end of a cable while a standard connector is used on the other. This arrangement has the advantage of allowing devices to use a proprietary connector to connect to a standardized device.

In some applications it is desirable to reduce the size of these connectors. For example, a low height, or smaller z direction, allows a connector to be used on a thinner device. A narrower connector, a shorter x direction, allows more connectors to be included along an edge of a device.

Unfortunately, smaller connectors require pin spacing to be reduced. Reduced spacing results in a higher level of signal crosstalk and interaction. This in turn diminishes signal integrity and hampers device performance.

Smaller connectors may also create an undesirable user experience. That is, it may be hard for users to know when they have properly inserted the cable connector into the device connector. It may be hard for users to know if they have inserted the connector in the correct direction and whether they have fully inserted the connector.

Thus, what is needed are connectors having a reduced size, a high level of signal integrity, and provide a tactile feedback to users such that they can determine whether a connection has been properly made.

SUMMARY

Accordingly, embodiments of the present invention provide connectors having a smaller profile. The profile, or form factor, may be smaller in either or both height, or z direction, and width, or x direction. While these connectors are particularly useful as a smaller (Digital Visual Interface) DVI connector, referred to herein as a MicroDVI connector, the concepts described herein may be used with other types of connectors.

Various embodiments of the present invention provide an enhanced user experience by providing keys that prevent the cable from being inserted in the wrong direction. These keys are arranged in such a way as to prevent the pins of the connector from being damaged when the connector is improperly inserted, that is, when it is inserted upside down.

In another exemplary embodiment of the present invention, the user experience is also enhanced by the use of one or more fingers. As the connector is inserted, the finger provides resistance that builds until the connector is inserted a certain distance, after which the resistance releases, letting the user know the connection has been made. These or other fingers may also be used to provide a tight mechanical connection.

In various embodiments of the present invention, signal integrity is maintained in the smaller form factor connector by using a number of techniques. For example, in the connector, analog pins are located on one side of a board, while digital pins are located on the other. Spacing between pins is arranged to provide necessary impedances over frequency. Differential lines are located near each other and their trace lengths and routing are matched.

An exemplary embodiment of the present invention provides a connector receptacle to receive a connector insert. This connector receptacle includes a first key formed on a wall of the connector receptacle, the key formed to fit with a narrow portion of the connector insert, and a finger formed on the wall of the connector receptacle. The finger is formed to provide resistance as the connector insert is initially inserted in the connector receptacle, and to release the resistance once the connector insert has been inserted into the connector receptacle a certain distance.

Another exemplary embodiment of the present invention provides a connector insert to be inserted into a connector receptacle. This connector insert includes an insert portion having a wider portion and a narrower portion, the narrower portion to fit into the connector receptacle having a key formed on an inner wall of the connector receptacle, and a top surface to meet a finger formed on the inner wall of the connector receptacle, the finger formed to provide resistance as the connector insert is initially inserted in the connector receptacle, and to release the resistance once the connector insert has been inserted into the connector receptacle a certain distance.

Yet another exemplary embodiment of the present invention provides a connector comprising a connector receptacle and a connector insert. This connector includes a connector receptacle having a first key formed on an inner wall of the connector receptacle, and a finger formed on the inner wall of the connector receptacle, and a connector insert having an insert portion having a wider portion and a narrower portion, the narrower portion to fit into the connector receptacle where the key is formed, and a top surface to meet the finger, the finger formed to provide resistance as the connector insert is initially inserted in the connector receptacle, and to release the resistance once the connector insert has been inserted into the connector receptacle a certain distance.

Various embodiments of the present invention may incorporate one or more of these and the other features described herein. A better understanding of the nature and advantages of the present invention may be gained by reference to the following detailed description and the accompanying drawings.

BRIEF DESCRIPTION OF THE DRAWINGS

FIG. 7 illustrates a specific pinout employed by a connector receptacle according to an embodiment of the present invention;

DESCRIPTION OF EXEMPLARY EMBODIMENTS

Figure 1:
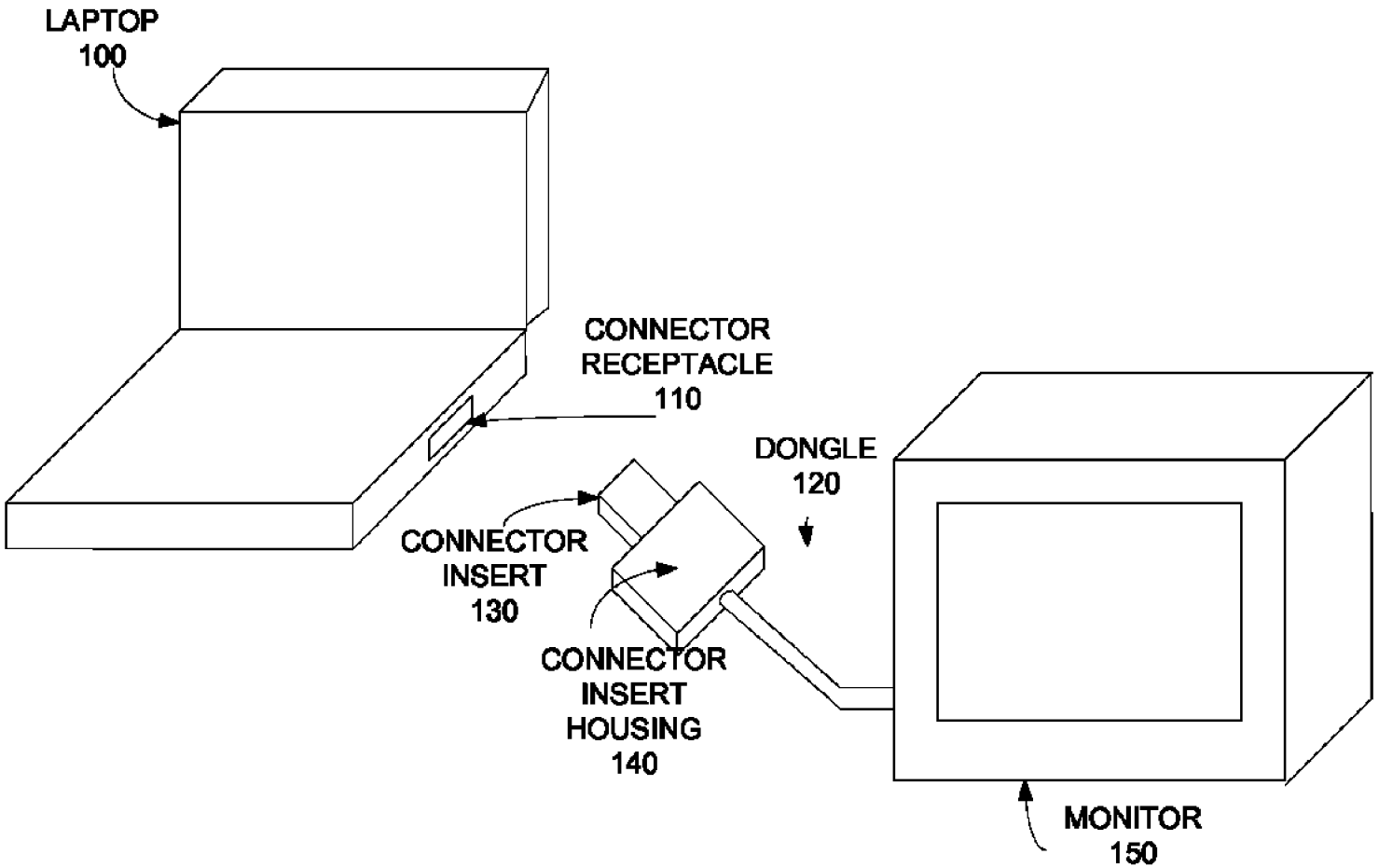
FIG. 1 illustrates an electronic system utilizing a connector including a connector receptacle and connector insert according to an embodiment of the present invention.

FIG. 1 illustrates an electronic system utilizing a connector including a connector receptacle and connector insert according to an embodiment of the present invention. This figure includes a laptop computer 100 that has a proprietary MicroDVI connector that is capable of driving a second monitor. This figure, as with the other included figures, is shown for illustrative purposes only and do not limit either the possible embodiments of the present invention or the claims.

In this example, the laptop 100 includes a connector receptacle 110 according to an embodiment of the present invention. This connector receptacle 110 may be located on other types of electronic devices, for example, portable media devices, cameras, set-top boxes, computers, and others. The use of a connector receptacle 110 having a lower height, or shorter z direction, on the laptop allows the laptop to be thinner, and therefore more easily transported. When the connector receptacle 110 is narrower, or shorter in the x direction, more connectors may be placed on the side of the laptop 100.

A cable, or in this case a dongle 120, connects to the connector receptacle 110 using a connector insert 130. A connector insert housing 140 is provided to allow electrical connections to be made between wires in the cable 120 and pins located in the connector insert 130. The connector housing 140 also provides something for a user to hold while inserting the connector insert 130 into the connector receptacle 110.

The other end of the cable or dongle 140 may be a standard or proprietary connection. For example, where the connector receptacle 110 provides pins for a Digital Visual Interface, the second end of the cable 140 may be a standard Video Graphics Array (VGA) or DVI connector. This connector may be used to make a connection to the monitor.

While embodiments for of the present invention are particularly well suited to provide a reduced size DVI connector receptacle and connector insert, other embodiments of the present invention may be employed for other types of connections. Also, in the future, other types of interfaces will be developed, and these connector receptacles and connector inserts will be useful for those as well.

Figure 2:
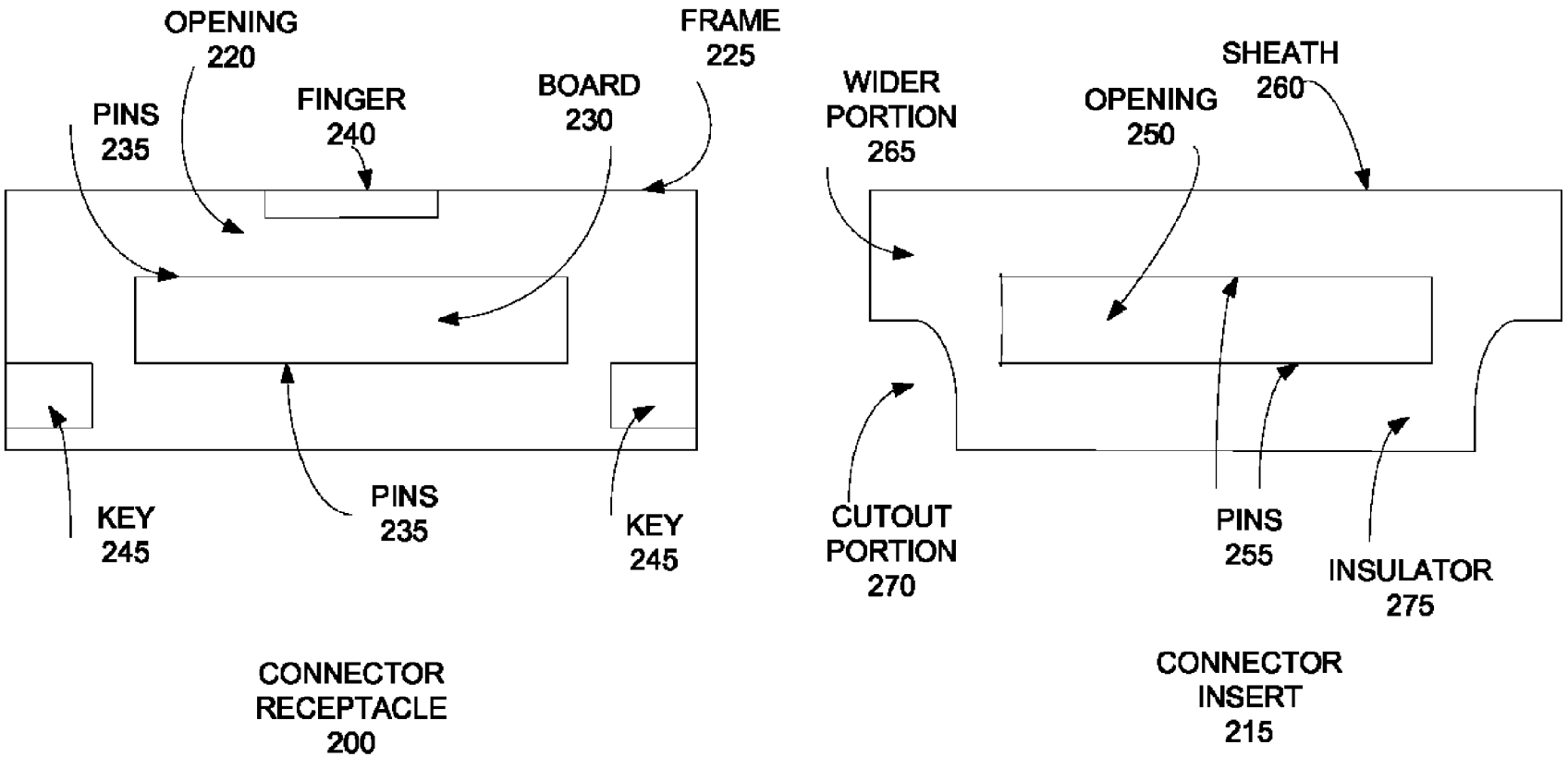
FIG. 2 illustrates a connector receptacle and connector insert according to an embodiment of the present invention.

FIG. 2 illustrates a front view of a connector receptacle 200 and connector insert 215 according to an embodiment of the present invention. When used as a MicroDVI connector, the profiles of the connector insert 200 and connector receptacle 215 are shorter, or narrower, or both shorter and narrower, than a standard DVI connector.

The connector receptacle 200 comprises an opening 220 that is bounded by a frame 215. The frame 215 may be made of metal or other conductive or nonconductive material. The opening includes a board 230. This board 230 may be a PC board made of an insulating or other type of material. The board 230 may have a number of pins 235 on one or both sides. The board 230 may also have pins on the ends, though such pins are not shown in this example.

The connector receptacle 200 in this example includes a finger 240 and two keys 245, though in other embodiments of the present invention, other numbers of fingers and keys may be used. In yet other embodiments of the present invention, one or more keys or one or more fingers may be used. For example, fingers may be included on the top, bottom, or sides of the connector to apply pressure and ensure a secure mating between the insert and receptacle during use. These fingers and keys may be made of metal, for example, they may be stamped or otherwise formed as part of the connector receptacle frame, or they may be made of other materials.

The connector insert 215 is typically solid having an opening 250 in which the board 230 is inserted during use. The opening 250 may have pins 255 on its top and bottom. Also, the opening 250 may have pins on the sides, though such pins are not shown in this example. The connector insert 215 may be enclosed in a sheath 260 that is made of metal or other material. The sheath 260 may at least partially surround an insulating material such as plastic, such that the pins do not electrically short to the sheath.

The connector insert 215 includes a wider portion 265 and a narrower portion. The narrower portion is narrower where a portion has been cut, shown here as a cutout portion 270 on each end of the connector insert 215.

When the connector insert 215 is properly inserted into the connector receptacle 200, the cutout portion 270 of the connector insert 215 avoids the keys 245 in the connector receptacle 200. When the connector insert 215 is improperly inserted, that is, it is inserted upside down, the wider portion 265 of the connector insert 215 is blocked by the keys 245, thereby preventing insertion and possible resulting damage to the connector or connected electronic devices.

As the connector insert 215 is inserted into the connector receptacle 200, the finger portion 240 of the connector receptacle 200 provides a level of resistance to the user. As the connector insert 215 is inserted past a point, the finger 240 releases this resistance, thereby indicating to the user that the connector insert 215 is properly seated in the connector receptacle 200. Fingers and keys are explained further in the following figures.

Figure 3:
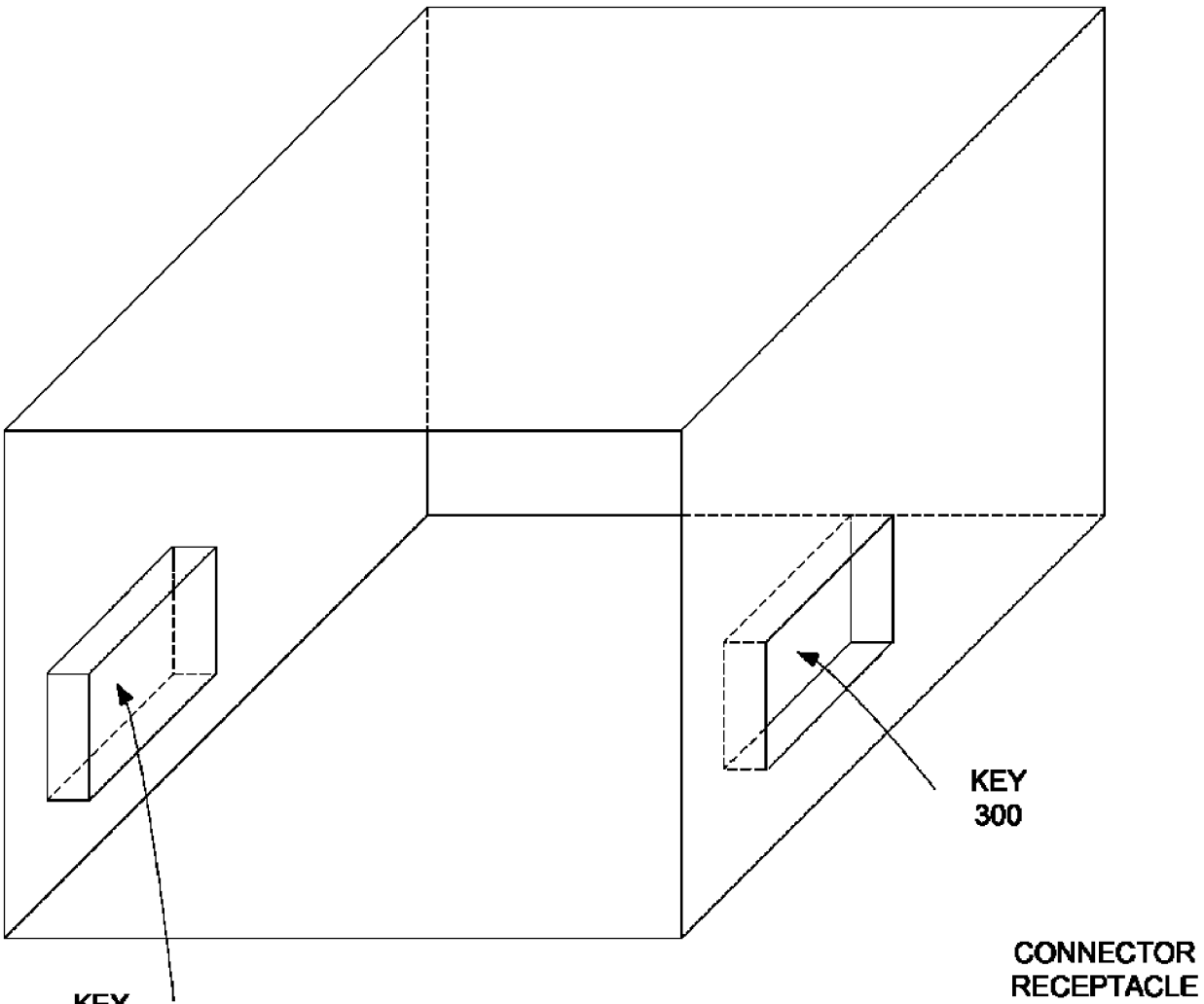
FIG. 3 illustrates two keys in a connector receptacle according to an embodiment of the present invention.

FIG. 3 illustrates two keys 300 in a connector receptacle 320 according to an embodiment of the present invention. In this example, two keys 300 are shown, one on each side of the connector receptacle 320 opening. These keys 300 may be formed by stamping. Alternately, these keys 300 may be formed using another appropriate method. While in this example, the keys 300 are shown as rectangular in nature, in practical receptacles 320, these keys 300 may be curved, triangular in nature, or they may have other shapes.

Specifically, the shape of the keys 300 as viewed from the front of the connector receptacle 320 may be rectangular, curved, or it may have other shapes. Further, viewed from the side of the connector receptacle 320, the keys 300 may also be rectangular, curved, or may have other shapes. The keys 300 may be recessed from the front of the opening of the connector receptacle 320. It is desirable that when a connector insert is inserted backwards, or upside down, that the keys 300 give the user a clear indication that the connector insert is being incorrectly inserted. That is, the key or keys 300 should provide a non-reversible connection rejection feature. It is also desirable that the keys 300 block insertion in such a way as to prevent damage to the connector receptacle board (not shown) and related circuitry. In a specific embodiment, the key 300 prevents an incorrectly inserted connector insert from breaking the face plane of the connector receptacle 320.

Figure 4:
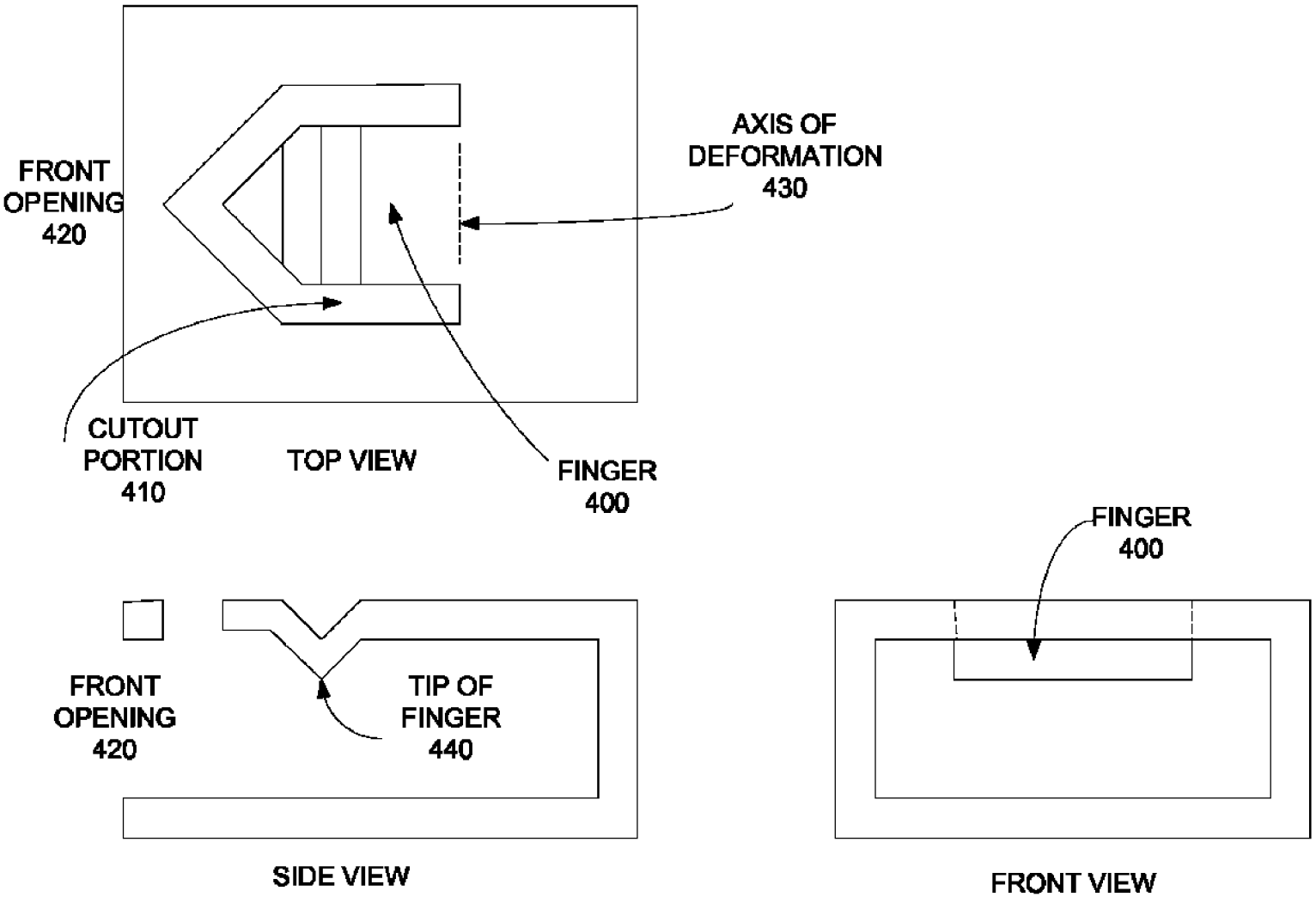
FIG. 4 illustrates top, side, and front views of a finger on a connector receptacle according to an embodiment of the present invention.

FIG. 4 illustrates top, side, and front views of a finger 400 on a connector receptacle according to an embodiment of the present invention. As can be seen from the top view, the finger 400 can be formed by removing a cutout portion 410 on one side of the connector receptacle. In a specific embodiment of the present invention, the cutout portion 410 is removed on the top of the connector receptacle, though in other embodiments of the present invention, it may be located on another side of the connector receptacle. As shown in this example, the finger 400 includes an indented portion that is bent into the cavity formed by the connector receptacle inner wall, though in other embodiments, other shapes may be used.

As a connector insert is inserted into the front opening 420 of the connector receptacle, the finger 400 provides an initial resistance to the user. As the user pushes the connector insert into the connector receptacle, the finger 400 deforms roughly along the axis of deformation 430 as shown. When the connector insert reaches the tip of the finger 400, the finger 400 stops providing resistance and the insert can either continue to be pushed in, or is at this point completely pushed in, depending on the specific implementation used. This provides tactile feedback to the user that the connection has been made and improves the user experience. In a specific embodiment of the present invention, the tactile experience is akin to that of a snap, letting the user know that a connection has been achieved. That is, the finger 400 provides cognitive feedback that a connection has been made.

Once the connector insert has been correctly inserted into the connector receptacle, it is desirable that this connection has a high degree of mechanical stability. Accordingly, embodiments of the present invention employ additional fingers to provide this stability. In a specific embodiment, four additional fingers (not shown) are used. Two of these fingers are on the top of the connector receptacle and two of these fingers are on the bottom. The fingers are all oriented in a direction opposite the finger shown in FIG. 4. Specifically, these fingers point towards the back of the receptacle, away from the receptacle opening. When inserted, these fingers apply an amount of pressure to the top and bottom of the connector insert, thus providing the desired stability.

Figure 5:
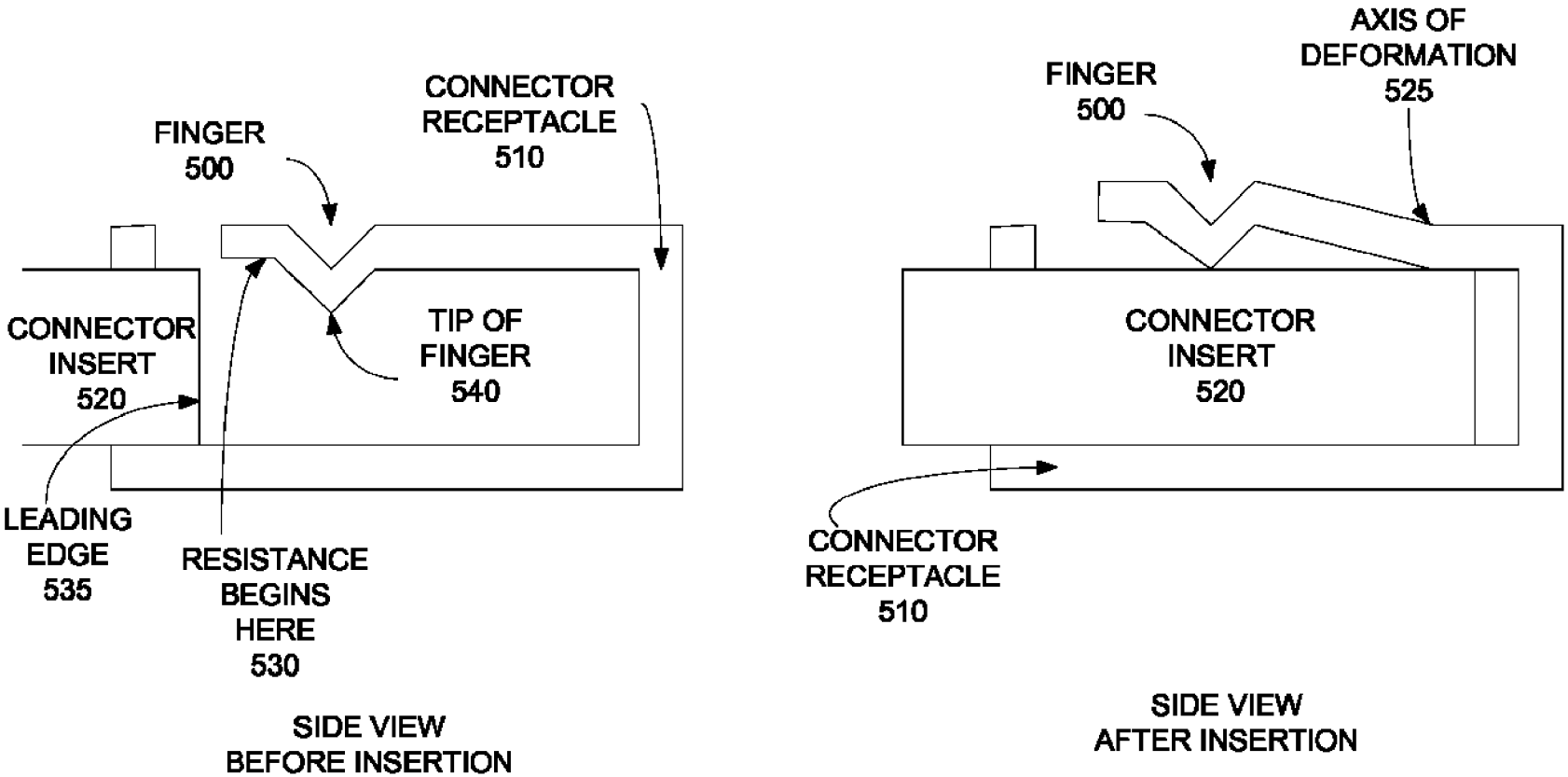
FIG. 5 illustrates the deformation of a finger as a connector insert is inserted into a connector receptacle according to an embodiment of the present invention.

FIG. 5 illustrates the deformation of a finger as a connector insert is inserted into a connector receptacle according to an embodiment of the present invention. As can be seen in the side view of the connector receptacle before insertion, the finger 500 blocks the connector insert 520 as it is fitted into the connector receptacle 510. The finger 500 deforms out of the way, again roughly along the axis of deformation 525 as shown, once the connector insert 520 is inserted into the connector receptacle 510.

Again, this finger 500 provides resistance once the connector insert 520 reaches the leading edge 530 of the finger 500, and stops providing resistance once the connector insert leading edge 535 passes the tip of FIG. 540. It should be noted that while the finger 500 has a particular shape in these examples, fingers may have other shapes in other embodiment of the present invention. For example, rather than coming to a point, a finger may have a more rounded point. Alternately, it may have a more rectangular or squared edge.

Figure 6:
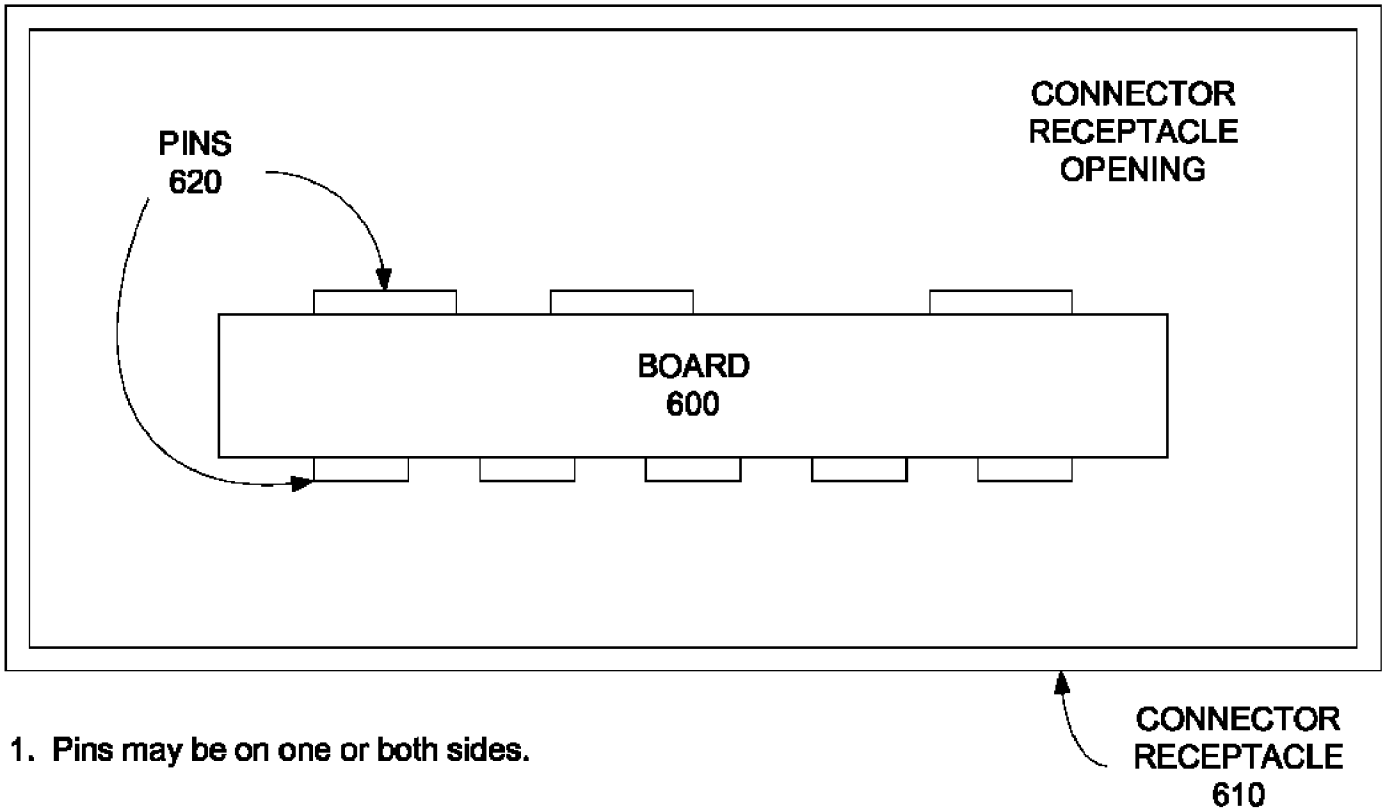
FIG. 6 illustrates a board located in a connector receptacle according to an embodiment of the present invention.

FIG. 6 illustrates a board 600 located in a connector receptacle 610 according to an embodiment of the present invention. The board 600 has a number of pins 620, which may alternately be referred to as pads, on one or both sides. The pins 620 may be formed using surface mount technology or other appropriate method. The pins 620 on each side may have different sizes and spacing to adjacent pins as compared other pins on that side. Also, in embodiments where pins are on both sides, the pins on one side may have different sizes and spacings as compared to pins on the other side.

In a specific embodiment of present invention, in a general manner, the analog and related pins are on one side of the board, while the digital and related pins are on the other side of the board. For example, analog pins for a DVI connector that are meant to drive a VGA monitor may be on one side of the board, while digital pins intended to drive a digital monitor may be located on the other side of the board.

In this embodiment of the present invention, the analog pins are inactive when a digital monitor is being driven and the digital pins are inactive when an analog monitor is driven. Accordingly, only one set of pins is used at a time. Since pins on only one side of the board are active at a time, crosstalk from one side of the board to the other is not problematic. Since this crosstalk is not a concern, the rows can be closer together, that is, the board itself can be thinner. This reduces the height of the connector. In other embodiments of the present invention, both may be used simultaneously. In such an embodiment, a y-cable may be used to separate VGA and Transition Minimized Differential Signaling (TMDS) signals to their respective monitors.

FIG. 7 illustrates a specific pinout employed by a connector receptacle according to an embodiment of the present invention. Again, in this example, the pins used to drive a digital display are primarily located on the top of the board, while the pins used to drive to an analog VGA display are primarily located on the bottom of the board. More specifically, when a digital or DVI monitor is driven, the active pins include pins 1-17 along the top, and pins 18 and 34 at the corners on the bottom. When an analog or VGA monitor is being driven, the active pins include pins 18-33 along the bottom, and 1, 15, and 16 near the corners at the top. The grounds can also be considered active in both modes of operation.

On the top side of the board, the digital differential pins are kept together as adjacent pins. Each differential pair is isolated from nearby differential pins by a ground pin. This is true for the TMDS0, TMDS1, and TMDS2 pins. It is also true for the TMDS clock signals. On the bottom side, the VGA red, green, and blue pins are isolated by ground return lines and no-connects. These no connects may be open spots on the board, or there may be a pin that is not connected. In other embodiments of the present invention, these no connects are tied to each other. In still other embodiments of the present invention, they may also be tied to a shield, frame, sheath, or other appropriate ground. Also in this embodiment, each ground for each VGA color is routed back though the cable or dongle as a separate wire. This prevents ground drops from a color output from disturbing the other color outputs.

This specific embodiment of the present invention provides a single link DVI interface. Other embodiments of the present invention provide a dual link interface. Also, in the future, other types of interfaces will be developed, and connector receptacles and connector inserts according to embodiments of the present invention may be used for those as well.

In a specific embodiment of the present invention, the differential pins are separated from each other by a distance that allows a specification of transmission line impedance to be met. In one embodiment, this specification requires a differential impedance of 100 ohms plus or minus 10 percent over frequency, up to a frequency of 2.2 GHz. Similarly, the VGA red, green, and blue pins are separated from each other and ground lines such that a specification of 75 ohms may be met up to a frequency of 2.5 GHz. This separation also reduces near-end and far-end crosstalk, thereby improving signal integrity.

In a specific embodiment of the present invention, the minimum pitch for each row is 0.5 mm, while the spacing is varied to meet the above impedance requirements and other parameters. Specifically, the signal to ground (return) pin spacing for the VGA red, green and blue signals are increased, relative to the spacing of the digital signals, so as to maintain a 75 ohm impedance at frequencies below 2.5 GHz. In this embodiment, the overall height of the board and pins is equal to or less than 4.64 mm, though in other embodiments of the present invention, other pitches and other heights may be used. Also, as described above, the pitch and separation of these pins may be varied. An example of this is shown in the following figure.

Figure 8A:
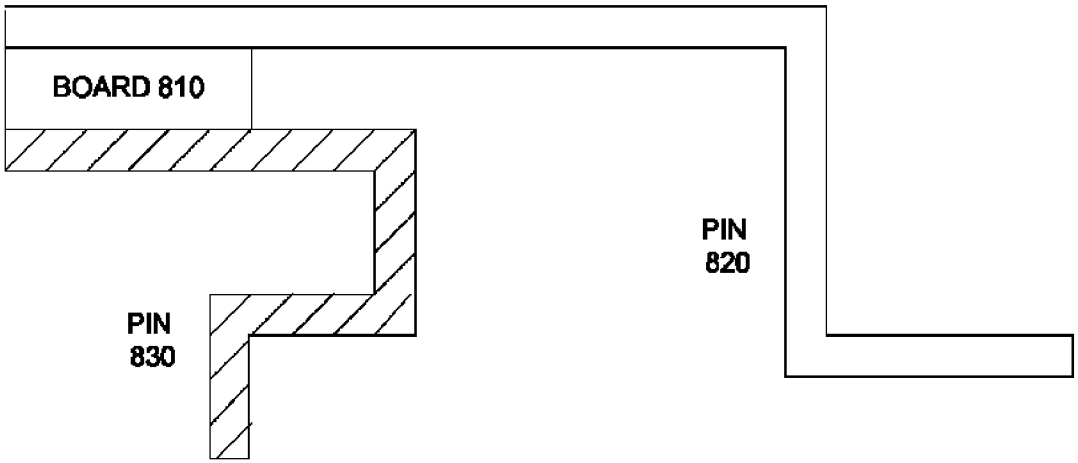
FIGS. 8A-8B illustrate through-hole and surface-mount pins according to an embodiment of the present invention.
Figure 8B:
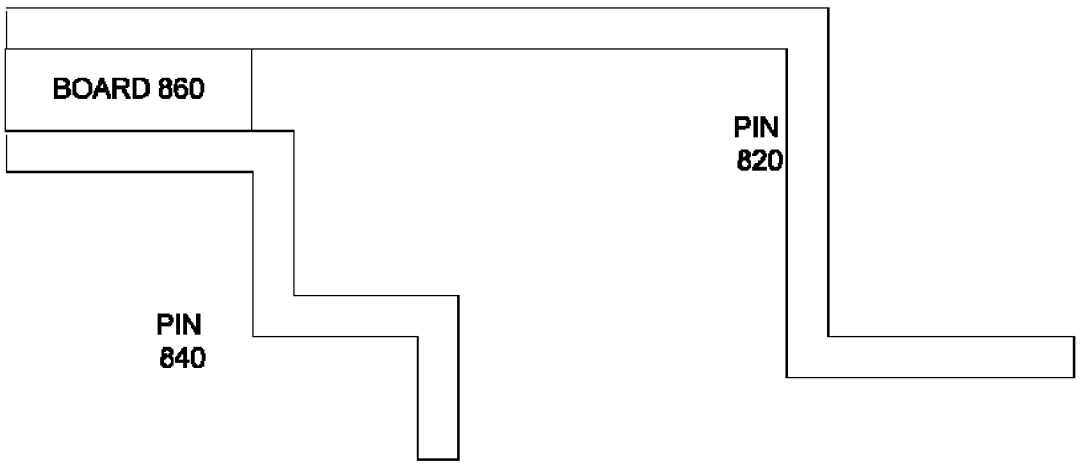

FIGS. 8A-8B illustrate a side view of through-hole and surface-mount pins according to an embodiment of the present invention. FIG. 8A illustrates two pins 820 and 830. Pin 820 is located on the top of the board 810, while pin 830 is located on the bottom of board 810. Pin 820 is a surface-mount pin, while pin 830 is a through-hole pin. These pins may have the same depth, that is, pin 820 may be located directly above pin 830, or they may be offset from each other. Again, this is a side view. In various embodiments of the present invention, these pins may be substantially flat, that is they appear as lines in the other dimensions, though in other embodiments of the present invention, they may have other shapes.

FIG. 8B also illustrates two pins 820 and 840. Pin 820 is located on the top of the board 810, while pin 840 is located on the bottom of board 810. Pin 820 is a surface-mount pin, while pin 840 is a through-hole pin. These pins may have the same depth, that is, pin 820 may be located directly above pin 840, or they may be offset from each other.

The shape of pins 830 and 840, that is, the manner they are bent or routed, allows these lines to have approximately the same length. Having the same length means that signals on pins 830 and 840 have the same delay. That is, pins 830 and 840 contribute the same amount of delay to their respective signals. This is particularly important when carrying differential signals, such as the differential digital signals used in DVI signaling. This promotes signal integrity and reduces the generation of EMI.

Figure 9:
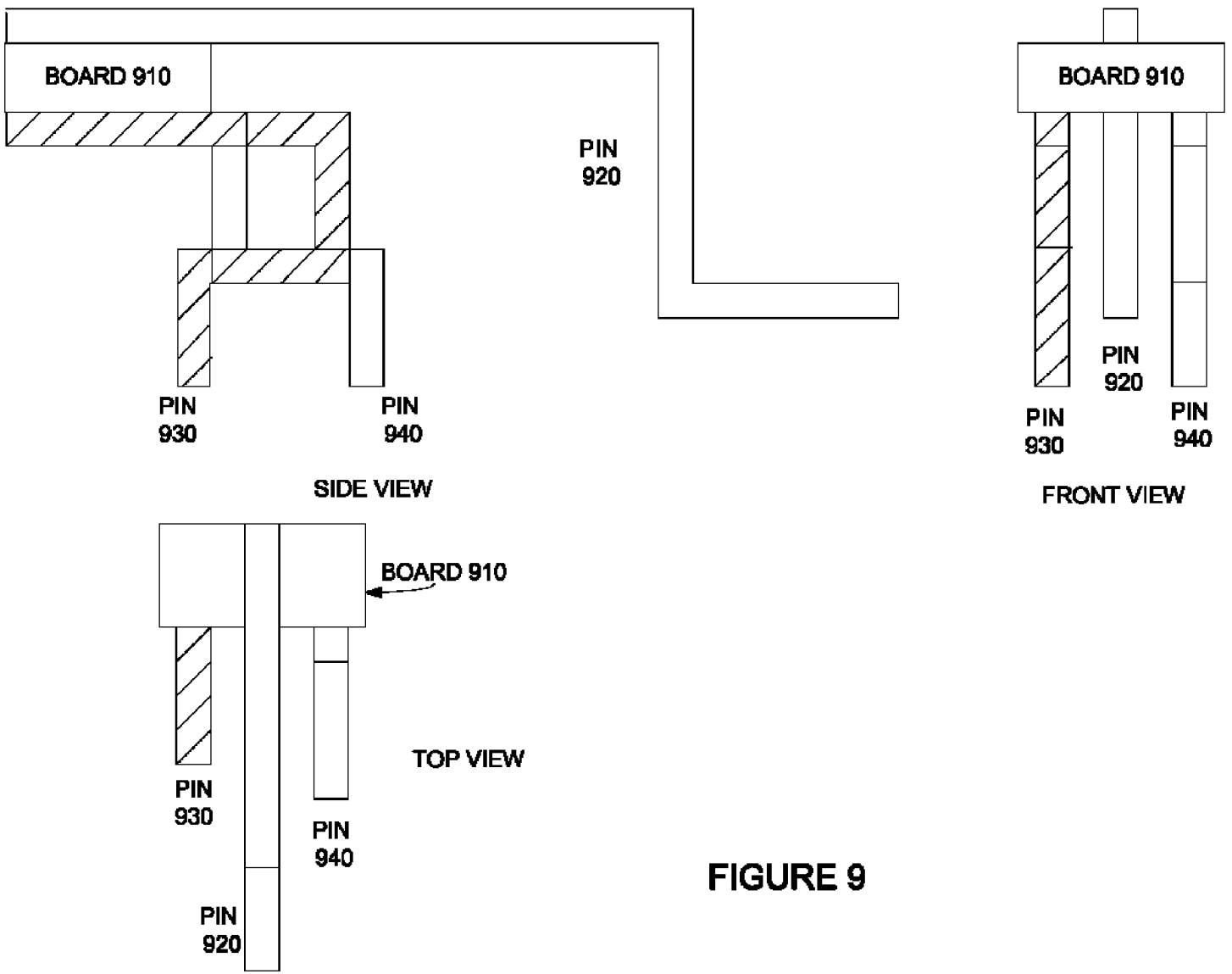
FIG. 9 illustrates a method of routing a pair of differential signals in a connector according to an embodiment of the present invention.
Figure 10:
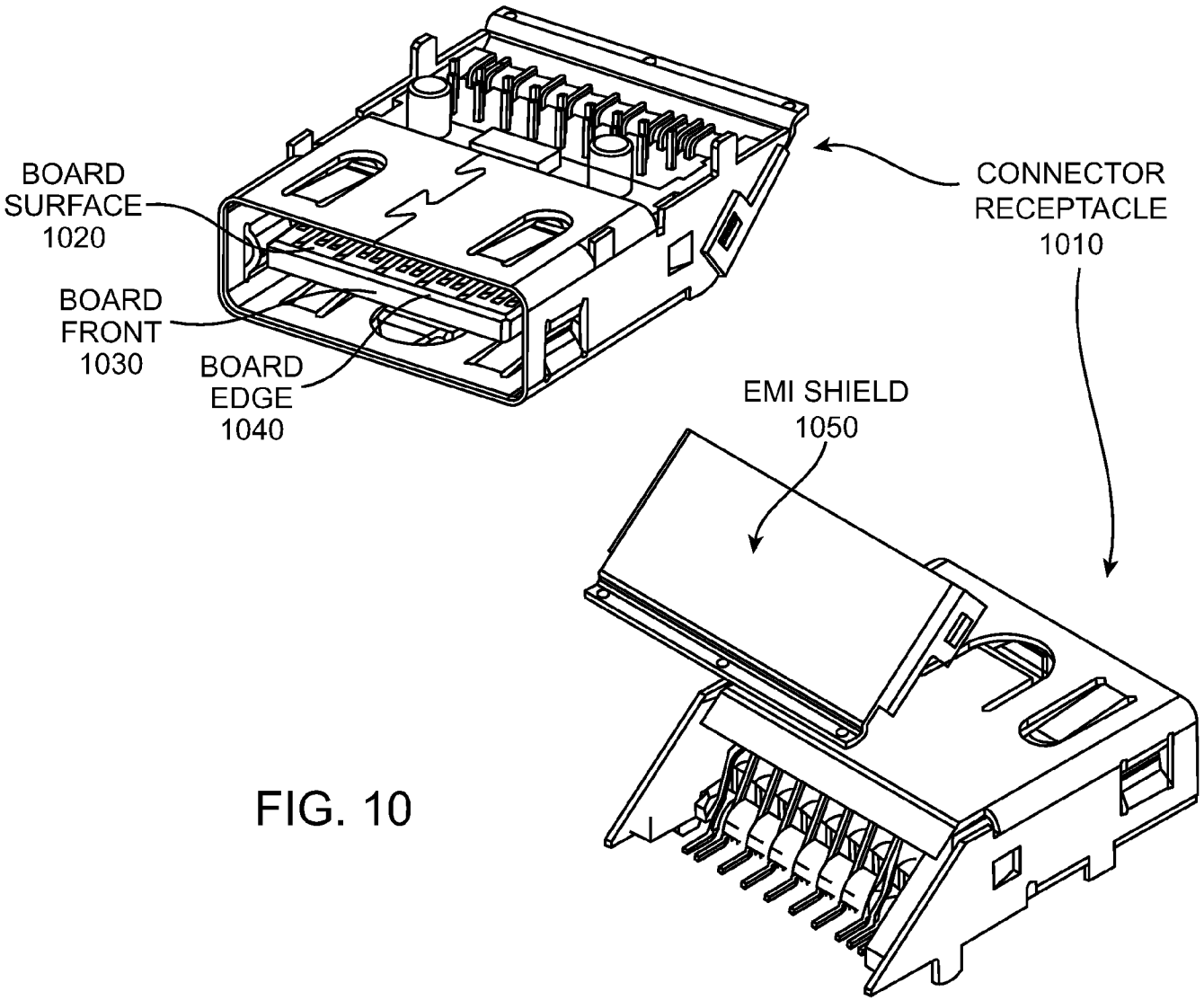
FIGS. 10-14 are mechanical diagrams of a connector receptacle according to an embodiment of the present invention.
Figure 11:
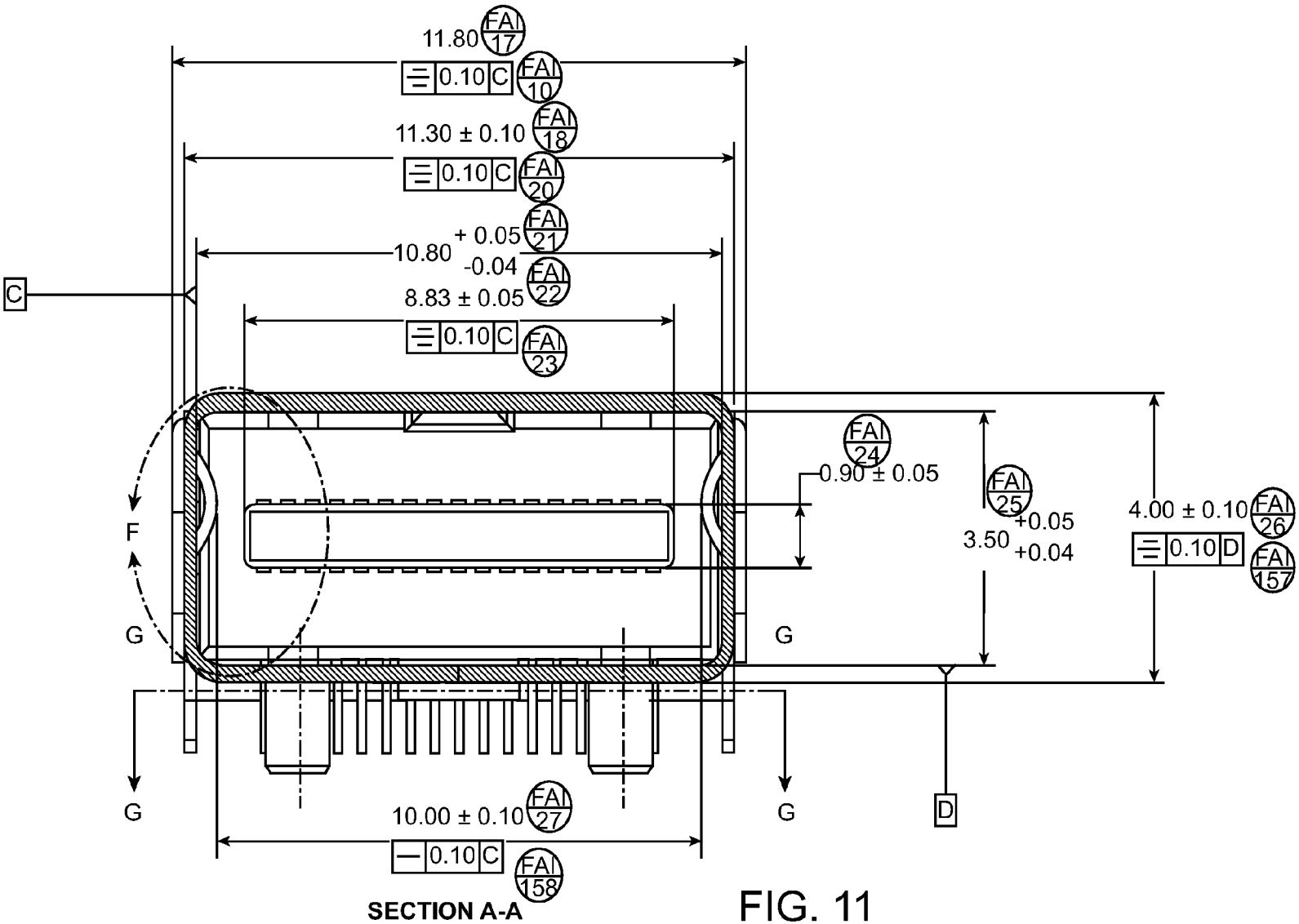
Figure 12:
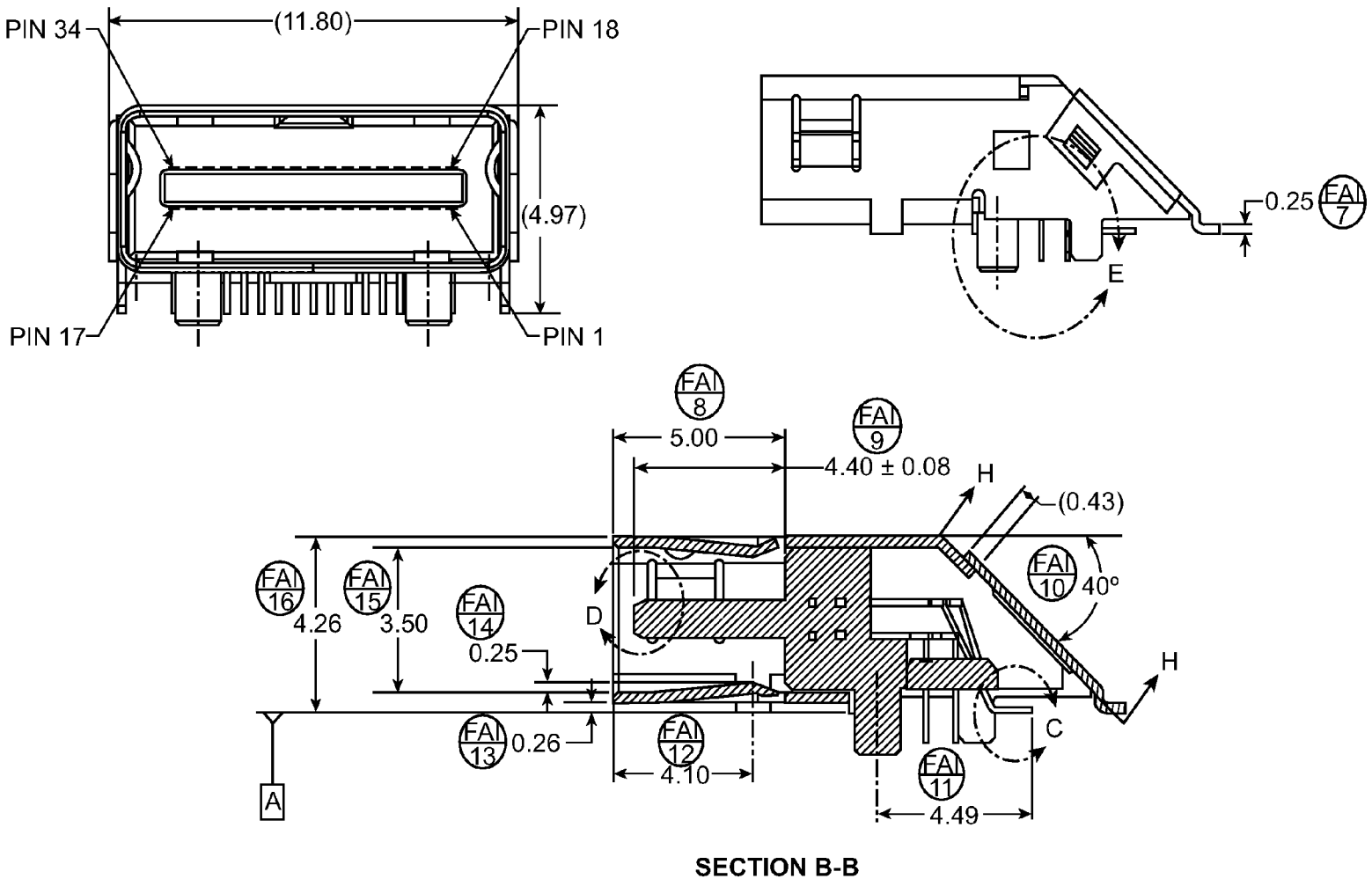
Figure 12:
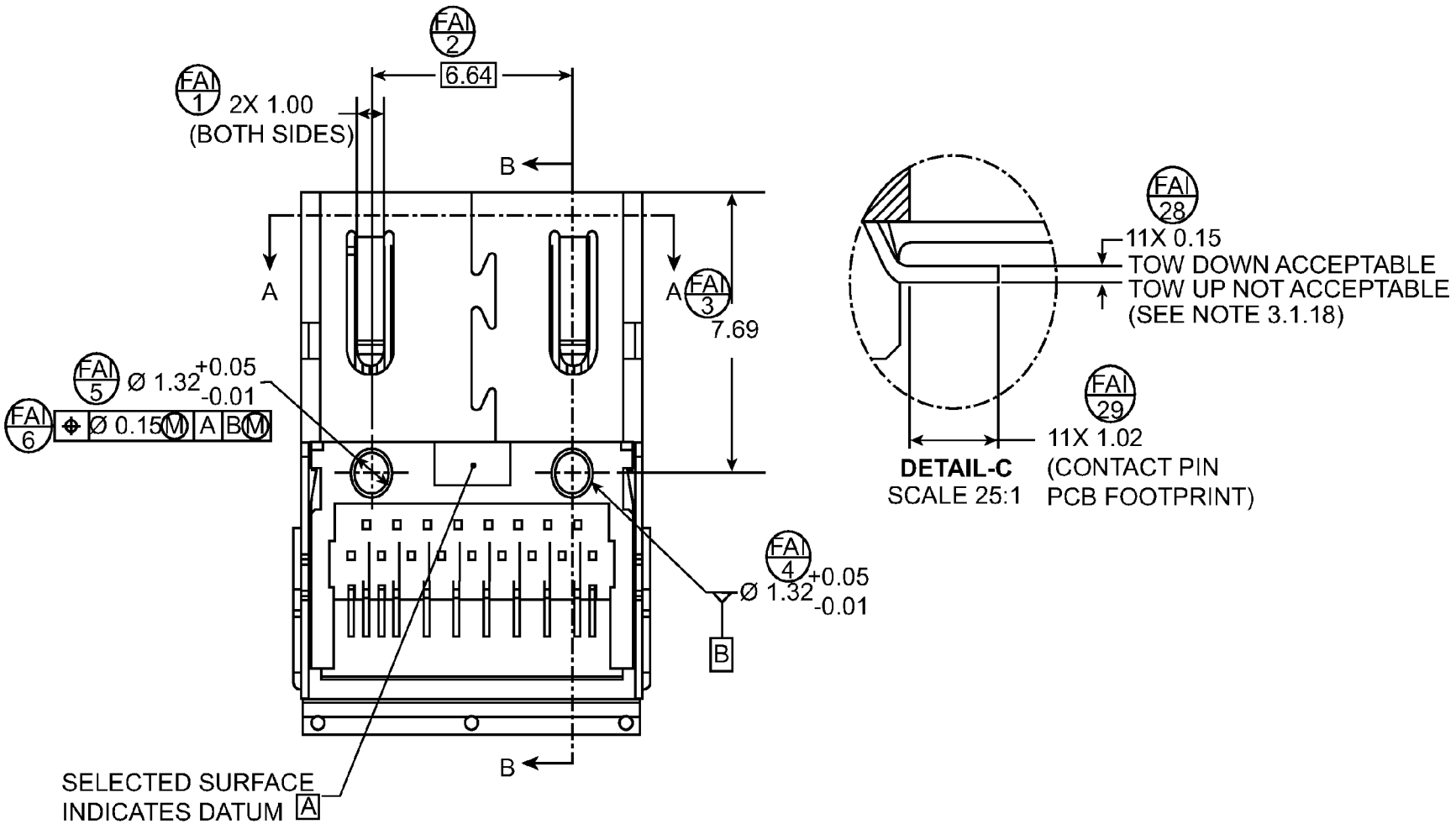
Figure 13:
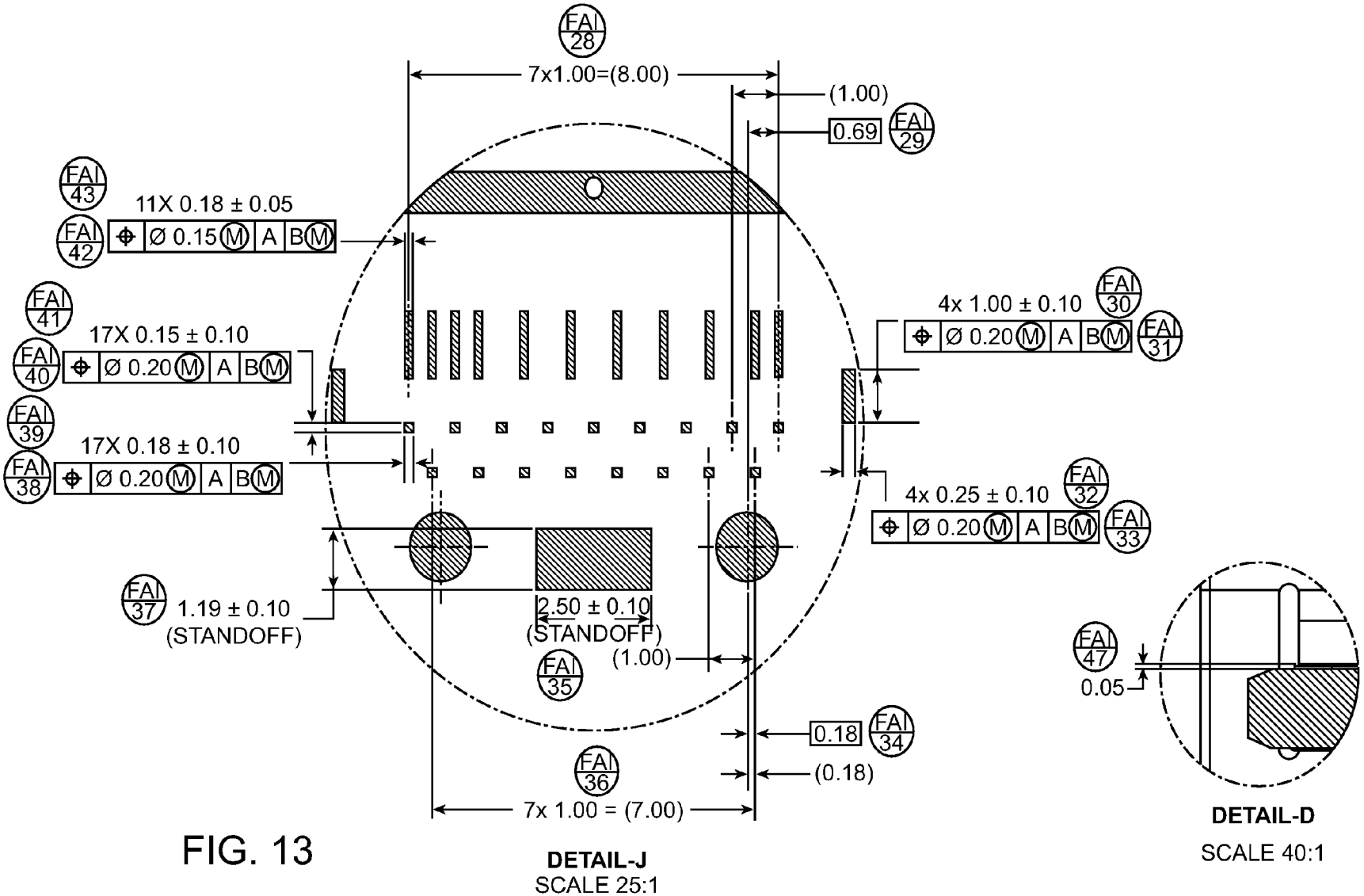
Figure 13:
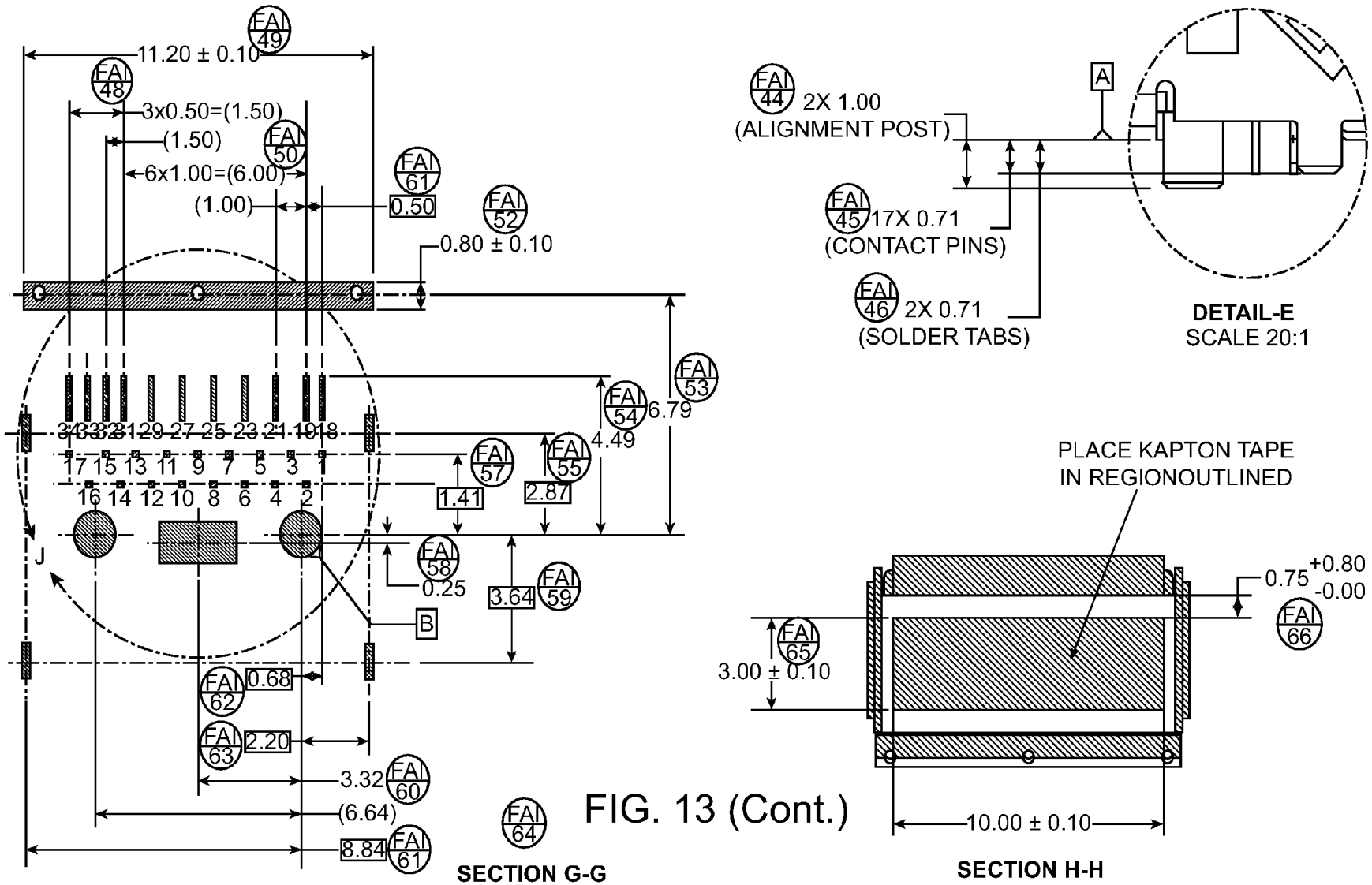
Figure 14:
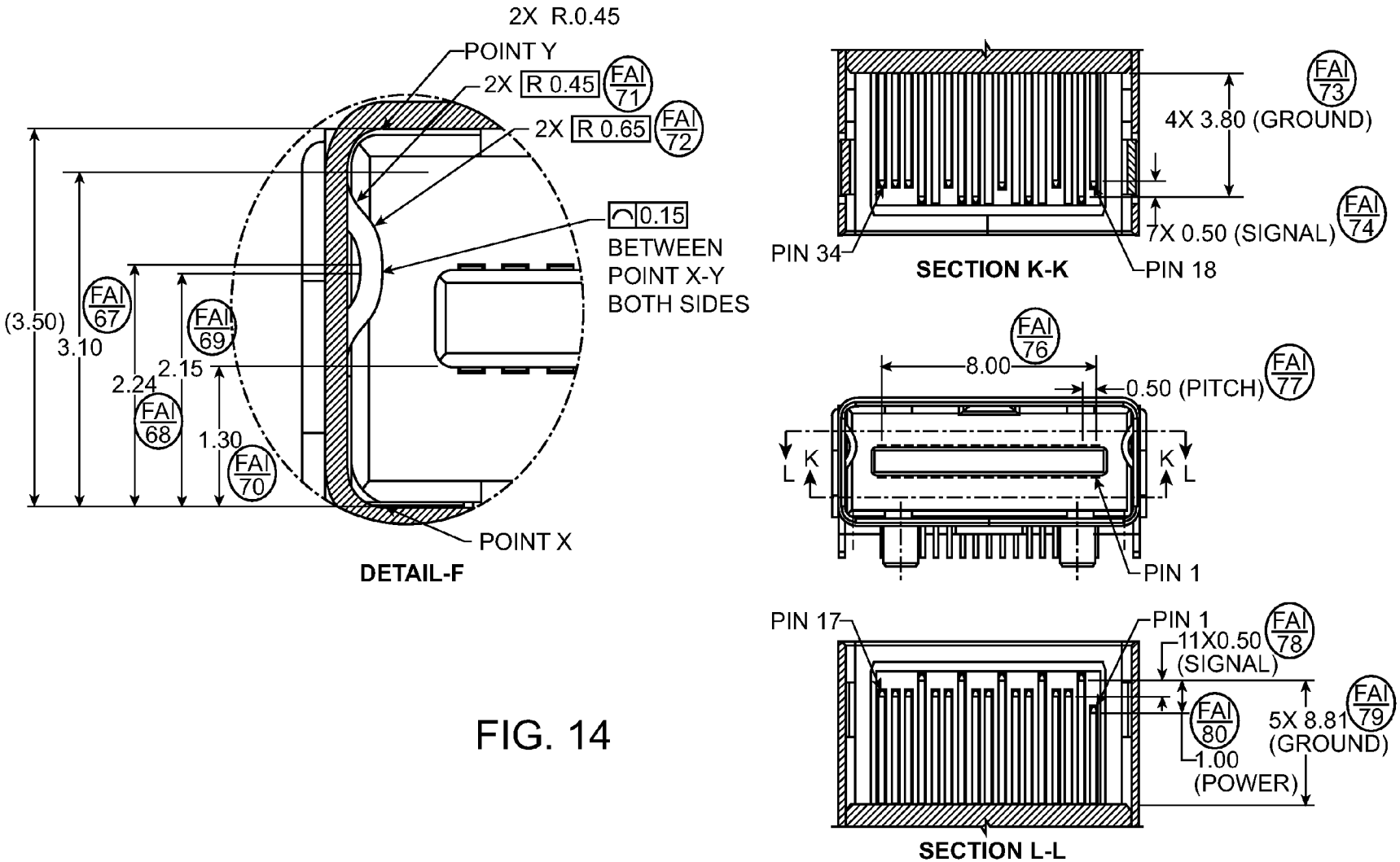

FIG. 9 illustrates side, front, and top views of three pins 920, 930, and 940. These pins correspond to pins 820, 830, and 840. Pin 920 is located on the top of the board 910, while pins 930 and 940 are located on the bottom of board 810. Pin 920 is a surface-mount pin, while pins 930 and 940 are through-hole pins.

Pins 930 and 940 are bent or routed in such a manner that they terminate at points that are at a distance from each other. Again, if these differential pair lines were closer, the solder used to make an electrical connection in the through holes may create shorts, thereby reducing yield. Having pins 930 and 940 terminate at a distance prevents solder bridging between them when they are connected to a board or other substrate. The shape of these pins also allows the pins 930 and 940 to be close to each other in a direction along the face of the connector receptacle. This arrangement allows the board to be manufactured with a high yield while reducing the linear space along the front of the connector. Additionally, mutual inductance between the pins is reduced by virtue of the reduced loop-area between adjacent pins. This again promotes signal integrity and allows connectors provided by embodiments of the present invention to achieve a high level of signal integrity and manufacturability, as well as a reduced level of EMI.

The pins 920, 930, and 940 may be soldered to a board internal to the electronic device. This board may be a flex connector, PC board, or other appropriate substrate. In a specific embodiment of the present invention, the connector receptacle has three rows of contacts to the internal board. Two of these rows are through-hole pins that are inserted into the connecting PC board, flex board, or other substrate. These rows include pins 930 and 940. The outside most row of pins are surface-mount pins. This row includes pin 920. This arrangement allows for inspection of the connection of the connector receptacle to the substrate.

In a specific embodiment of the present invention, the through-hole pins are used for analog signals, in particular to carry analog VGA signals. In this embodiment, the digital differential DVI signals are assigned to the surface-mount pins, 920.

Specifically, with the connector receptacle on the top of the substrate, the through-hole pins can be inspected for contact to the bottom of substrate. Also from the top, the surface mount connection to the top of the substrate can be inspected. These connections are accessible and can therefore be reworked in the case of a soldering error.

FIGS. 10-14 are mechanical diagrams of a connector receptacle according to an embodiment of the present invention. The particular dimensions shown provide a connector having a high level of manufacturability. They also provide a connector receptacle having a high level of signal integrity and impedance matching. They also provide a connector receptacle having a reduced EMI.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A connector receptacle to receive a connector insert, the connector receptacle comprising:

a first key formed in an inner wall of the connector receptacle, the key formed to fit with a narrow portion of the connector insert;

a finger formed on the inner wall of the connector receptacle, the finger formed to provide resistance as the connector insert is initially inserted in the connector receptacle, and to release the resistance once the connector insert has been inserted into the connector receptacle a certain distance; and a board comprising a first plurality of pins on a first side of the board and a second plurality of pins on a second side of the board, wherein the first plurality of pins are analog signal pins and the second plurality of pins are digital signal pins, the digital signal pins including a pair of differential digital signal pins, wherein a first one of the differential signal pins has a first portion extending a first horizontal distance from the board and terminates at a second horizontal distance from the board, the first horizontal distance longer than the second horizontal distance, and a second one of the differential signal pins has a first portion extending a third horizontal distance from the board and terminates at a fourth horizontal distance from the board, the fourth horizontal distance longer than the third horizontal distance.

2. The connector receptacle of claim 1 wherein the board inserts into an opening in the connector insert.

3. The connector receptacle of claim 2 wherein the connector receptacle provides signal pins for a Digital Visual Interface compatible display.

4. The connector receptacle of claim 3 wherein the first plurality of pins provide signals for a VGA compatible display.

5. The connector receptacle of claim 4 wherein the second plurality of pins provide signals for a digital monitor.

6. The connector receptacle of claim 3 wherein the opening forms a smaller area than a standard Digital Visual Interface connector receptacle.

7. The connector receptacle of claim 4 wherein the connector receptacle has the following pins definitions:

Pin 1: DDC Power;
Pin 2: GND;
Pin 3: TMDS 2P;
Pin 3: TMDS 2N;
Pin 4: GND;
Pin 6: TMDS 1P;
Pin 7: TMDS 1N;
Pin 8: GND;
Pin 9: TMDS CLKP;
Pin 10: TMDS CLKN;
Pin 11: GND;
Pin 12: TMDS 0P;
Pin 13: TMDS 0N;
Pin 13: GND;
Pin 14: DDC CLK;
Pin 16: DDC DAT;
Pin 17: DVI host pull-up/down
Pin 18: Hot-plug detect; and
Pin 33: HDMI host pull-up/down.

8. The connector receptacle of claim 7 wherein the connector receptacle has the following pins definitions:

Pin 1: DDC Power;
Pin 14: DDC CLK;
Pin 16: DDC DAT;
Pin 18: Hot-plug detect;
Pin 19: GND;
Pin 21: VGA red;
Pin 23: GND (VGA red return);
Pin 24: VGA green;
Pin 27: GND (VGA green return);
Pin 29: VGA blue;
Pin 31: GND (VGA blue return);
Pin 32: VGA HSYNC; and
Pin 33: VGA VSYNC.

9. The connector receptacle of claim 4 wherein the pair of differential digital signal pins have substantially the same length and are routed to provide a separation between their terminating ends.

10. The connector receptacle of claim 4 wherein the pair of differential digital signal pins have substantially the same length, and are shaped such that a loop area between adjacent pins is minimized.

11. The connector receptacle of claim 1 wherein one or more of the digital pins are surface-mount and one or more of the analog pins are through-hole pins.

12. A connector insert to be inserted into a connector receptacle, the connector insert comprising:

an insert portion having a wider portion and a narrower portion, the narrower portion to fit into the connector receptacle having a key formed in an inner wall of the connector receptacle;

a top surface to meet a finger formed on the inner wall of the connector receptacle, the finger formed to provide resistance as the connector insert is initially inserted in the connector receptacle, and to release the resistance once the connector insert has been inserted into the connector receptacle a certain distance; and an opening comprising a first plurality of pins on a first side of the opening and a second plurality of pins on a second side of the opening, wherein the first plurality of pins provide signals for an analog monitor, and wherein the second plurality of pins provide signals for a digital monitor.

13. The connector insert of claim 12 wherein the opening receives a board formed in an opening in the connector receptacle.

14. The connector insert of claim 13 wherein the first plurality of pins are analog pins and the second plurality of pins are digital pins.

15. The connector insert of claim 13 wherein the connector insert provides signal pins for a Digital Visual Interface.

16. The connector insert of claim 15 wherein the first plurality of pins provide signals for a VGA monitor.

17. The connector insert of claim 15 wherein the connector insert has a smaller area than a standard Digital Visual Interface connector insert.

18. A connector comprising a connector receptacle and a connector insert, the connector comprising:

the connector receptacle having a first key formed on an inner wall of the connector receptacle, and a finger formed in the inner wall of the connector receptacle, the connector receptacle further comprising a board having a first row of pins on a first side and a second row of pins on the second side, wherein the first row of pins and the second row of pins provide pins for a digital visual interface; and the connector insert having an insert portion having a wider portion and a narrower portion, the narrower portion to fit into the connector receptacle where the key is formed; and a top surface to meet the finger, the finger formed to provide resistance as the connector insert is initially inserted in the connector receptacle, and to release the resistance once the connector insert has been inserted into the connector receptacle a certain distance.

19. The connector of claim 18 further comprising an opening in the connector insert to receive a board formed in an opening in the connector receptacle, the opening in the connector insert comprising a first plurality of pins on a first side of the opening and a second plurality of pins on a second side of the opening.

20. The connector of claim 18 wherein the first row of pins are analog pins and the second row of pins are digital pins.

21. The connector of claim 18 wherein the first row of pins provides signals for a VGA monitor.

22. The connector of claim 21 wherein the second row of pins provides signals for a digital monitor.

23. The connector of claim 18 wherein the connector has a smaller form factor than a standard Digital Visual Interface connector.

* * * * *